US010588197B2

(12) United States Patent
Chiu et al.

(10) Patent No.: US 10,588,197 B2
(45) Date of Patent: Mar. 10, 2020

(54) LIGHT EMITTING MODULE

(71) Applicant: PEGATRON CORPORATION, Taipei (TW)

(72) Inventors: Yu-Hao Chiu, Taipei (TW); Tzu-Ming Yang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/424,155

(22) Filed: May 28, 2019

(65) Prior Publication Data

US 2019/0373703 A1 Dec. 5, 2019

(30) Foreign Application Priority Data

Jun. 4, 2018 (TW) ..... 107119139 A

(51) Int. Cl.
*H01J 1/62* (2006.01)
*H05B 33/14* (2006.01)
*H05B 33/22* (2006.01)

(52) U.S. Cl.
CPC ..... *H05B 33/145* (2013.01); *H05B 33/22* (2013.01)

(58) Field of Classification Search
None
See application file for complete search history.

(56) References Cited

U.S. PATENT DOCUMENTS 6,054,725 A * 4/2000 Liedenbaum ..... H01L 27/3239 257/103

FOREIGN PATENT DOCUMENTS

| | | |
|---|---|---|
| TW | 408901 | 10/2000 |
| TW | M548763 | 9/2017 |

* cited by examiner

*Primary Examiner* — Vip Patel
(74) *Attorney, Agent, or Firm* — J.C. Patents

(57) ABSTRACT

A light emitting module including a working piece and a light emitting film is provided. The light emitting film is disposed on a surface of the working piece and emits lights according to a voltage difference. The light emitting film includes a bottom layer, a pattern layer and a colour layer. The bottom layer is disposed on the surface of the working piece. The pattern layer is disposed on the bottom layer for providing a pattern. The colour layer is disposed on the bottom layer for providing a colour. The pattern layer and the colour layer are overlapped with each other over the bottom layer, so that the light emitting film forms a light emitting pattern with the pattern and the colour on the working piece.

13 Claims, 4 Drawing Sheets

LIGHT EMITTING MODULE

CROSS-REFERENCE TO RELATED APPLICATION

This application claims the priority benefit of Taiwan application serial no. 107119139, filed on Jun. 4, 2018. The entirety of the above-mentioned patent application is hereby incorporated by reference herein and made a part of this specification.

BACKGROUND

1. Technology Field

The present invention relates to a light emitting module.

2. Description of Related Art

In recent years, with the development of technology, the appearance motif of various electronic or digital products has also attracted attention. For example, the aforementioned product can at least partially have a light emitting appearance as a decoration by providing a light emitting module around the outer casing. In a conventional light emitting module, it is common practice to arrange a light emitting element suitable for light emission such as a light emitting diode element on the periphery of the outer casing of the aforementioned product. When the light emitting module needs to emit light of a plurality of different colours, it is necessary to mount light emitting elements having different light emitting colours.

However, the light emitting colour selection of the existing light emitting elements is limited, which is disadvantageous for the diversity of the light emitting module. Moreover, when the expected light emitting area (for example, the periphery of the outer casing) of the applied product is curved or has a complicated shape, it is difficult to uniformly arrange the light emitting elements on the expected light emitting area, which is disadvantageous for the practicality of the light emitting module. In addition, since the space for arranging the light emitting elements needs to be reserved inside the product, it is difficult to reduce the overall thickness of the product, and when the light emitting module is further equipped with optical elements such as a light pipe or a light-homogenizing plate to generate uniform brightness, it is not favorable for the thinning development of products.

SUMMARY OF THE INVENTION

The present invention provides a light emitting module, which has diversity and practicality, and is beneficial to the thinning development of products.

The light emitting module of the present invention includes a working piece and a light emitting film. The light emitting film is disposed on a surface of the working piece and used for emitting light according to a voltage difference. The light emitting film includes a bottom layer, a pattern layer and a colour layer. The bottom layer is disposed on the surface of the working piece. The pattern layer is disposed on the bottom layer for providing a pattern. The colour layer is disposed on the bottom layer for providing a colour. The pattern layer and the colour layer are overlapped with each other over the bottom layer, so that the light emitting film forms a light emitting pattern with the pattern and the colour on the working piece.

In one embodiment of the present invention, the pattern layer includes a plurality of motifs in the same shape. The motifs are spaced apart from each other with a gap and continuously arranged.

In one embodiment of the present invention, the motifs are identical in size to each other.

In one embodiment of the present invention, the size or arrangement density of the motifs varies from the middle to the two sides of the pattern layer.

In one embodiment of the present invention, the size or arrangement density of the motifs varies from one side to the other side of the pattern layer.

In one embodiment of the present invention, the pattern layer is located between the bottom layer and the colour layer, and the colour of the colour layer covers the motifs and the spacing gaps of the motifs.

In one embodiment of the present invention, the colour layer is located between the bottom layer and the pattern layer, and the colour of the colour layer is displayed through the spacing gaps of the motifs.

In one embodiment of the present invention, the colour provided by the colour layer is different from the colour of the bottom layer.

In one embodiment of the present invention, the colour provided by the colour layer produces a gradual change from one side to the other side of the colour layer.

In one embodiment of the present invention, the colour layer includes a plurality of adjacent regions. At least one of the regions provides the colour, and at least another one of the regions does not possess the colour.

In one embodiment of the present invention, the colour layer includes a plurality of adjacent regions. The colour provided by at least one of the regions is different from the colour provided by at least another one of the regions.

In one embodiment of the present invention, the bottom layer includes a backing layer, a dielectric layer, a light emitting layer and a conductive layer sequentially disposed on the working piece. The backing layer defines a light emitting region on the working piece. The dielectric layer, the light emitting layer and the conductive layer are sequentially disposed on the backing layer, and the voltage difference across the backing layer and the conductive layer excites the light emitting layer to emit light.

In one embodiment of the present invention, the light emitting film further includes a transparent layer disposed on the pattern layer and the colour layer, and located on the outermost side of the light emitting film.

Based on the above, the light emitting module of the present invention includes a working piece and a light emitting film used for emitting light according to a voltage difference, wherein the light emitting film includes a bottom layer, a pattern layer for providing a pattern, and a colour layer for providing a colour, so that the light emitting film forms a light emitting pattern with the pattern and the colour on the working piece. Therefore, compared with the conventional light emitting module, the light emitting module of the present invention does not need to use light emitting elements such as a light emitting diode element or optical elements such as a light guiding column, the action of arranging the light emitting film can be applied to various materials or working pieces having complicated shapes, and can further be matched with different patterns and colours to achieve different appearance effects. Thereby, the light emitting module of the present invention has diversity and practicality, and is beneficial to the thinning development of products.

In order to make the aforementioned and other objectives and advantages of the present invention comprehensible, embodiments accompanied with figures are described in detail below.

DETAILED DESCRIPTION

Figure 1:
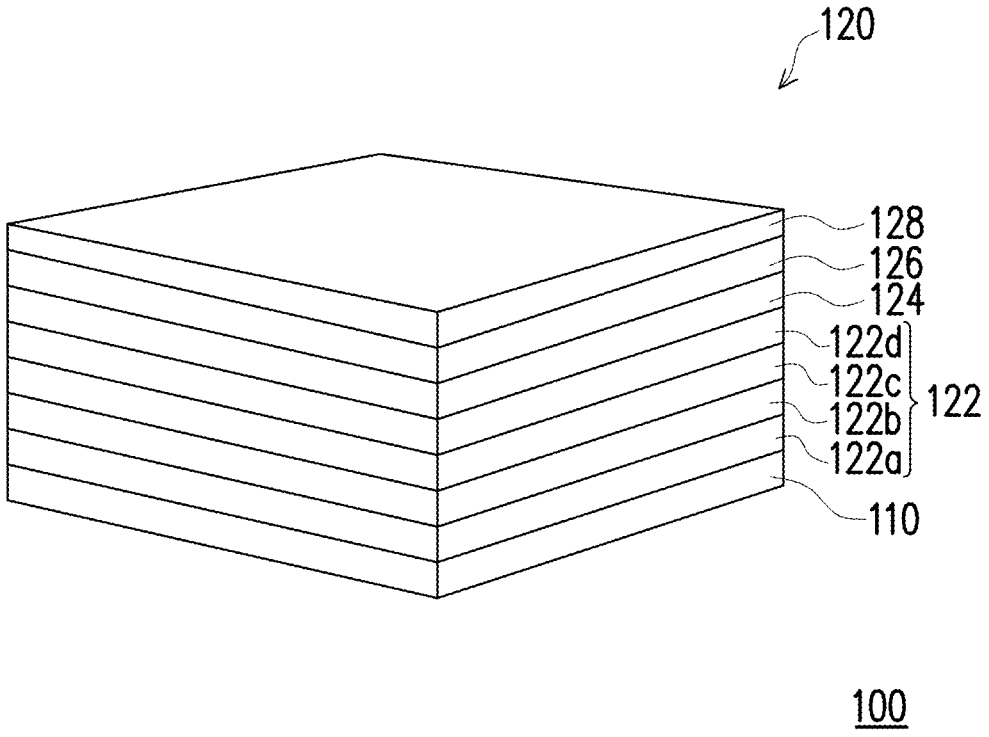
FIG. 1 is a three-dimensional view of a light emitting module according to an embodiment of the present invention.
Figure 2:
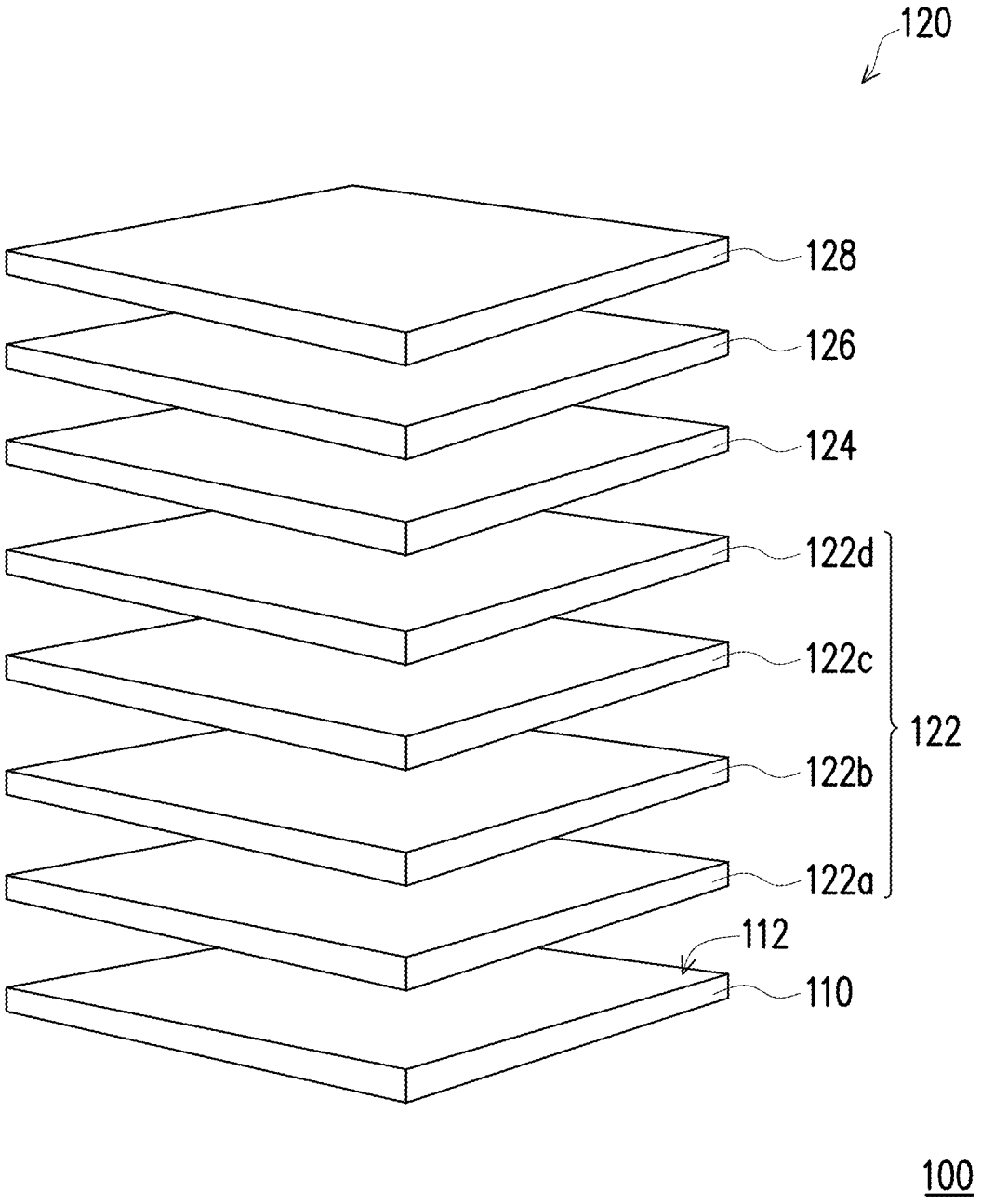
FIG. 2 is an exploded view of the light emitting module of FIG. 1.

FIG. 1 is a three-dimensional view of a light emitting module according to an embodiment of the present invention. FIG. 2 is an exploded view of the light emitting module of FIG. 1. Referring to FIG. 1 and FIG. 2, in the present embodiment, the light emitting module 100 includes a working piece 110 and a light emitting film 120. The working piece 110 is, for example, an outer casing of an electronic device (e.g., a notebook computer, a smart phone, a tablet computer, and the like) or a vehicle body, and the surface of the working piece 110 has a light emitting region 112 (e.g., at least a portion of the appearance surface of the working piece 110), the coverage (e.g., size or shape) of the light emitting region 112 may be adjusted according to the expected light emitting coverage (not shown) of the light emitting module 100, but the present invention does not limit the type of the working piece 110 and the coverage of the light emitting region 112. The light emitting film 120 is disposed on the surface of the working piece 110, for example, on the light emitting region 112, so that the surface of the working piece 110, such as at least a portion of the appearance surface (i.e., the light emitting region 112) emits light. That is, the light emitting film 120 is capable of being disposed on various types of working pieces 110 and emitting light according to requirements to be suitable for the light emitting module 100.

Specifically, in the present embodiment, the light emitting film 120 includes a bottom layer 122, a pattern layer 124 and a colour layer 126, which are sequentially disposed on the light emitting region 112 of the working piece 110. The bottom layer 122 is disposed on the surface of the working piece 110, and includes a backing layer 122*a*, a dielectric layer 122*b*, a light emitting layer 122*c* and a conductive layer 122*d* which are sequentially disposed on the light emitting region 112 of the working piece 110 in order to emit light according to the voltage difference. The backing layer 122*a* is, for example, a highly conductive low-resistance material suitable for defining the light emitting region 112 on the working piece 110. That is, the disposition region of the backing layer 122*a* on the working piece 110 would be regarded as the light emitting area 112, and the other films are disposed on the backing layer 122*a*, so that the working piece 110 emits light on the light emitting area 112. Furthermore, the dielectric layer 122*b*, the light emitting layer 122*c* and the conductive layer 122*d* are sequentially disposed on the backing layer 122*a* for allowing the light emitting film 120 to emit light. The dielectric layer 122*b* is, for example, an insulating material, which can be used for ensuring uniform distribution of current to generate uniform light, and for preventing burning or avoiding short circuit. The light emitting layer 122*c* is, for example, a light emitting material that defines the colour of the emitted light. The conductive layer 122*d* is, for example, a conductive material for distributing current and allows the light emitting layer 122*c* located between the dielectric layer 122*b* and the conductive layer 122*d* to emit light. Further, the light emitting film 120 may be an electroluminescent light emitting film 120. That is, when a conductive member (such as a copper sheet) and a connecting line (not shown) are disposed on the back surface of the working piece 110, an electric field generated by applying a voltage difference to the backing layer 122*a* and the conductive layer 122*d* excites the light emitting layer 122*c* to emit light under the action of an electromagnetic field. Thereby, in the present embodiment, the light emitting film 120 is composed of, for example, n-butyl acetate, xylene, n-butanol, 2-methoxy-1-methylethyl acetate, toluene, solvent naphtha, ethylbenzene, formaldehyde, iso-butanol, copper and silver. However, the present invention is not limited thereto, and adjustments can be made as needed.

Generally, the colour of the light emitted by the light emitting film 120 depends on the colour of the material of the film, but the colour of the material of the film is limited, and the film is mostly uniformly disposed on the light emitting region 112 and displays a uniformly distributed monochromatic colour, so the pattern layer 124 and the colour layer 126 are further added to the light emitting film 120 of the present embodiment, wherein the pattern layer 124 provides a pattern, and the colour layer 126 provides a colour (detailed as follows), so that the light emitted by the light emitting film 120 has a pattern and a colour so as to change the light emitting effect of the light emitting film 120.

Figures 3A, 3B, 3C:
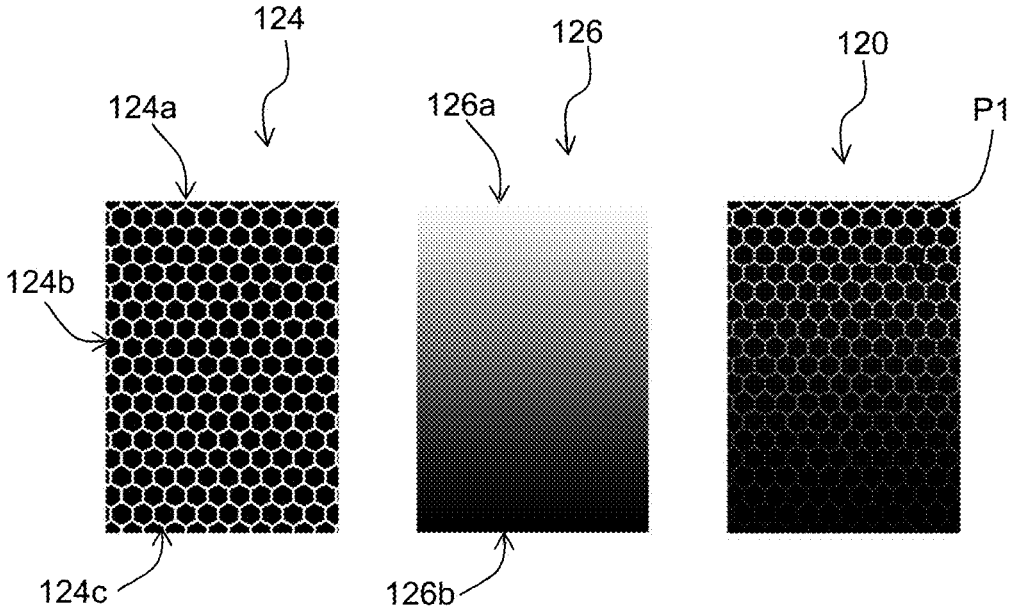
FIG. 3A is a plan view of a pattern layer of FIG. 2.
FIG. 3B is a plan view of a colour layer of FIG. 2.
FIG. 3C is a plan view of a light emitting film of FIG. 2.

FIG. 3A is a plan view of the pattern layer of FIG. 2. FIG. 3B is a plan view of the colour layer of FIG. 2. FIG. 3C is a plan view of the light emitting film of FIG. 2. Specifically, referring to FIG. 2 to FIG. 3C, in the present embodiment, the pattern layer 124 is located between the bottom layer 122 and the colour layer 126. The pattern layer 124 and the colour layer 126 are overlapped with each other over the bottom layer 122. The pattern layer 124 provides a pattern (as shown in FIG. 3A) and the colour layer 126 provides a colour (as shown in FIG. 3B), so that the light emitting film 120 generates a light emitting pattern P1 (as shown in FIG. 3C) with the pattern and the colour on the light emitting region 112.

In detail, in the present embodiment, the pattern layer 124 includes a plurality of motifs 124*a* in the same shape, for example, a regular hexagon. The motifs 124*a* are spaced apart from each other with a gap having uniform width and continuously arranged, and the motifs 124*a* are identical in size to each other to form a continuous pattern on both the long side 124*b* and the short side 124*c* of the pattern layer 124. However, in other embodiments not shown, other configurations may be used (as will be described later). Moreover, the colour provided by the colour layer 126 may have a gradual change from one side to the other side of the colour layer 126. For example, as shown in FIG. 3B, the colour deepens from the upper side 126*a* to the lower side 126*b* of the colour layer 126. However, the gradual change may also occur from the middle to the left and right sides or the upper and lower sides of the colour layer 126, or may be irregular, which may be adjusted according to requirements. Alternatively, in other embodiments (not shown), the colour layer may also have a uniformly distributed colour without a gradual change. In addition, the colour provided by the colour layer 126 is shown in grey scale in FIG. 3B, but may actually be various colours such as red, yellow, blue, and the like, preferably the colour provided by the colour layer 126 is different from the colour of the material of the bottom layer 122, but is not limited thereto. As such, the light emitting pattern P1 of the light emitting film 120 is formed by the pattern of the pattern layer 124 comprised of the motifs 124*a* and the colour provided by the colour layer 126 having the gradual change.

In the present embodiment, an exemplary manufacturing method of disposing the light emitting film 120 on the working piece 110 is as follows: firstly, the backing layer 122*a*, the dielectric layer 122*b*, the light emitting layer 122*c* and the conductive layer 122*d* are sequentially disposed in the light emitting region 112 of the working piece 110 to form the bottom layer 122. Next, the working piece 110 on which the bottom layer 122 has been disposed is introduced into a water transfer printing step, and the transfer pattern is transferred to the bottom layer 122 through the water transfer printing step to form the pattern layer 124. Then, colour paint is sprayed on the working piece 110 on which the bottom layer 122 and the pattern layer 124 have been disposed to form the colour layer 126. The pattern of the pattern layer 124 may be prepared as a transfer pattern in advance, and the gradual effect in the colour layer 126 can be achieved by controlling the spray manner in which the colour paint is sprayed (e.g., spray time, spray direction, or spray amount) on the light emitting region 112 from one side to the other side, but the present invention is not limited thereto.

Moreover, in the present embodiment, the light emitting film 120 further includes a transparent layer 128 disposed on the pattern layer 124 and the colour layer 126, and located at the outermost side of the light emitting film 120. As such, the transparent layer 128 covers the bottom layer 122, the pattern layer 124 and the colour layer 126 as a protective layer to prevent the transfer pattern serving as the pattern layer 124 and the colour paint serving as the colour layer 126 from falling off. Moreover, the transparent layer 128 may be formed by spraying a transparent varnish or matt paint on the pattern layer 124 and the colour layer 126 according to requirements to further generate a glossy or matt surface effect. In addition to providing protection, the transparent layer 128 changes the appearance of the light emitting pattern P1 formed by the light emitting film 120 in combination with the pattern layer 124 and the colour layer 126, but the present invention is not limited thereto.

In addition, the embodiment of FIG. 1 to FIG. 3C is exemplified by disposing the pattern layer 124 between the bottom layer 122 and the colour layer 126. However, in other embodiments (not shown), the colour layer 126 may also be located between the bottom layer 122 and the pattern layer 124. That is, the colour paint is firstly sprayed on the working piece 110 on which the bottom layer 122 has been disposed to form the colour layer 126, and then the working piece 110 on which the bottom layer 122 and the colour layer 126 have been disposed is introduced into the water transfer printing step to form the pattern layer 124 by the transfer pattern. However, the transmittance of the film disposed above is better than the transmittance of the film disposed below, so that when the light emitting film 120 is intended to emphasize the effect of the pattern layer 124 (e.g., emphasize the arrangement of the pattern 124*a* and the like), it is preferable to dispose the pattern layer 124 on the top of the colour layer 126, and at this time the colour of the colour layer 126 is displayed through the spacing gaps of the motifs 124*a*. When the light emitting film 120 is intended to emphasize the effect of the colour layer 126 (i.e., emphasize the gradual change of the colour), it is preferable to dispose the colour layer 126 on the top of the pattern layer 124, and at this time the colour of the colour layer 126 covers the pattern 124*a* and the spacing gaps of the pattern 124*a*. It can be seen that the present invention does not limit the order in which the pattern layer 124 and the colour layer 126 are disposed, which can be adjusted as needed, as long as the pattern layer 124 and the colour layer 126 are overlapped over the bottom layer 122 and covered by the transparent layer 128 located at the outermost side.

Figures 4A, 4B, 4C:
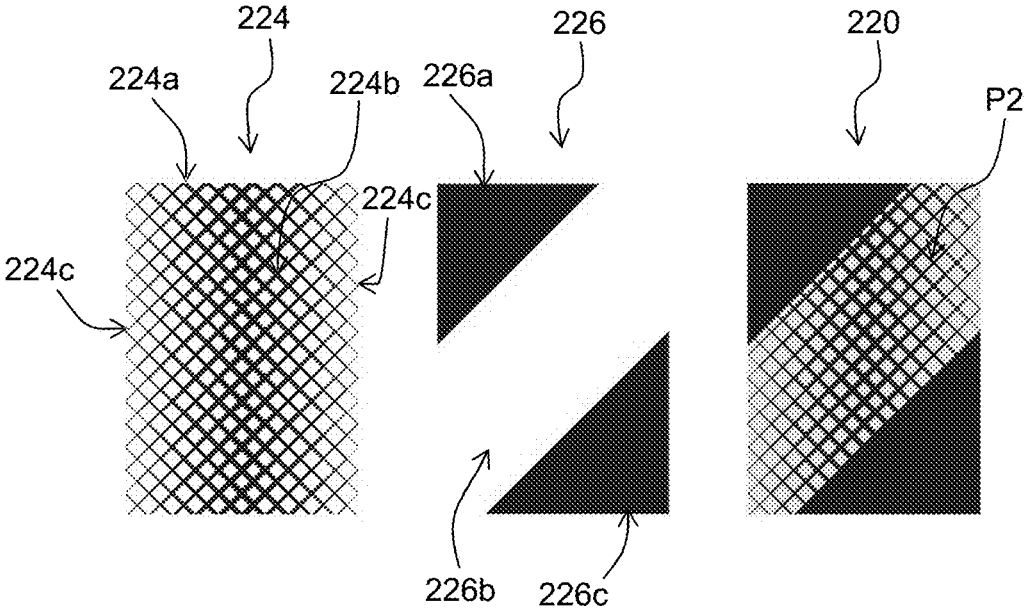
FIG. 4A to FIG. 4C are plan views of a pattern layer, a colour layer and a light emitting film according to another embodiment of the present invention.

FIG. 4A to FIG. 4C are plan views of the pattern layer, the colour layer and the light emitting film according to another embodiment of the present invention. Referring to FIG. 4A to FIG. 4C, in the present embodiment, the way the pattern layer 224, the colour layer 226 and the light emitting film 220 are substantially disposed is similar to the pattern layer 124, the colour layer 126 and the light emitting film 120 in FIG. 3A to FIG. 3C., The pattern layer 224 provides a pattern (as shown in FIG. 4A), and the colour layer 226 provides a colour (as shown in FIG. 4B) such that the light emitting film 220 forms a light emitting pattern P2 having the pattern and the colour (as shown in FIG. 4C). Thus, the main difference between the light emitting film 220 and the light emitting film 120 is the pattern provided by the pattern layer 224 and the colour provided by the colour layer 226.

In detail, in the present embodiment, the pattern layer 224 includes a plurality of motifs 224*a* in the same shape, for example, a diamond pattern The motifs 224*a* are spaced a gap apart from each other and continuously arranged, and the size of the motifs 224*a* varies from the middle 224*b* to the two sides 224*c* of the pattern layer 224 (e.g., the size of the motifs 224*a* increases from the middle 224*b* to the two sides 224*c*). However, in other embodiments (not shown), the arrangement density of the motifs 224*a* varies from the middle 224*b* to the two sides 224*c* of the pattern layer 224, or may have other dispositions and variations. Furthermore, the colour layer 226 includes a plurality of adjacent regions 226*a* to 226*c* (as shown in FIG. 4B). At least one of the regions 226*a* to 226*c* (e.g., regions 226*a* and 226*c*) provides a colour while at least another one of the regions 226*a* to 226*c* (e.g., region 226*b*) does not possess that colour, or the colour provided by at least one of the regions 226*a* to 226*c* (e.g., regions 226*a* and 226*c*) is different from the colour provided by at least another one of the regions 226*a* to 226*c* (e.g., region 226*b*), which can be achieved by selecting whether to spray the colour paint or to spray colour paint in a different colour in the step of constituting the colour layer 226. In addition, the colour provided by the colour layer 226 is black and white in FIG. 4B, but may be various colours such as red, yellow, blue, and the like, preferably, the colour provided by the colour layer 226 is different from the colour of the bottom layer 122 (shown in FIG. 2). Besides, although the regions 226*a* to 226*c* shown in FIG. 4B are obliquely juxtaposed block regions, in other embodiments (not shown), they may be more detailed graphics, such as specific decorative graphics or trademark graphics, and the present invention is not limited thereto. As such, the light emitting pattern P2 of the light emitting film 220 is formed by the pattern of the pattern layer 224 comprised of the motifs 224*a* and the colour provided by the colour layer 226 having at least one of the regions 226*a* to 226*c* with a different colour or without that colour.

Figures 5A, 5B, 5C:
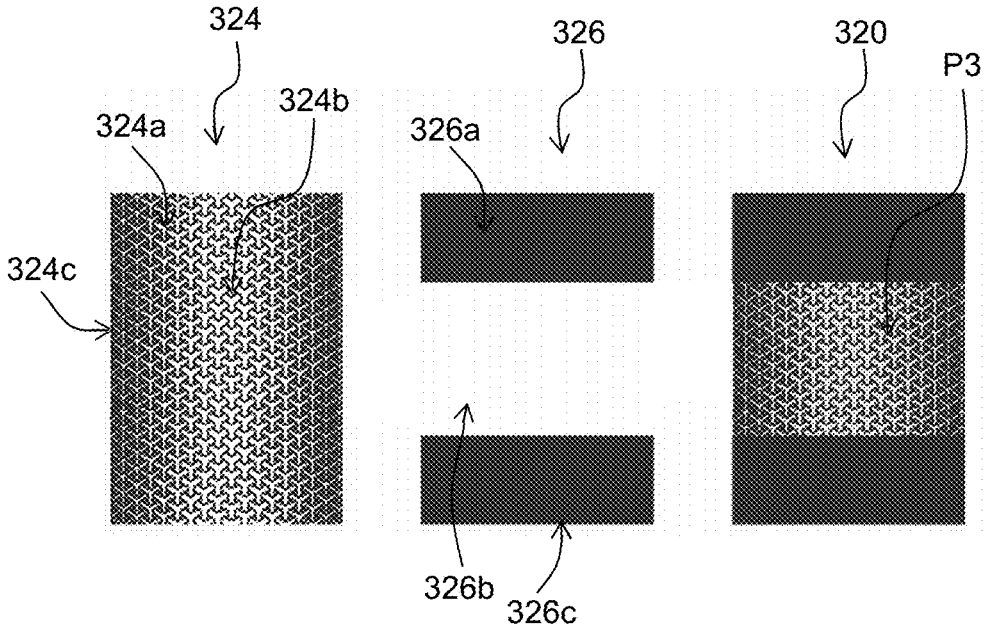
FIG. 5A to FIG. 5C are plan views of a pattern layer, a colour layer and a light emitting film according to still another embodiment of the present invention.

FIG. 5A to FIG. 5C are plan views of the pattern layer, the colour layer and the light emitting film according to still another embodiment of the present invention. Referring to FIG. 5A to FIG. 5C, in the present embodiment, the way the pattern layer 324, the colour layer 326 and the light emitting film 320 are substantially disposed is similar to the pattern layer 124, the colour layer 126 and the light emitting film 120 in FIG. 3A to FIG. 3C. The pattern layer 324 provides a pattern (as shown in FIG. 5A), and the colour layer 326 provides a colour (as shown in FIG. 5B) such that the light emitting film 320 forms a light emitting pattern P3 having the pattern and the colour (as shown in FIG. 5C). Thus, the main differences between the light emitting film 320 and the light emitting film 120 are the pattern provided by the pattern layer 324 and the colour provided by the colour layer 326.

In detail, in the present embodiment, the pattern layer 324 includes a plurality of motifs 324*a* in the same shape, for example, a Y-shaped motif. The motifs 324*a* are spaced a gap apart from each other and continuously arranged, and the size of the motifs 324*a* varies from the middle 324*b* to the two sides 324*c* of the pattern layer 324 (e.g., the size of the motifs 324*a* decreases from the middle 324*b* to the two sides 324*c*). However, in other embodiments (not shown), the arrangement density of the motifs 324*a* varies from the middle 324*b* to the two sides 324*c* of the pattern layer 324, or may have other dispositions and variations. Furthermore, the colour layer 326 includes a plurality of adjacent regions 326*a* to 326*c* (as shown in FIG. 5B). At least one of the regions 326*a* to 326*c* (e.g., regions 326*a* and 326*c*) provides a colour while at least another one of the regions 326*a* to 326*c* (e.g., region 326*b*) does not possess that colour, or the colour provided by at least one of the regions 326*a* to 326*c* (e.g., regions 326*a* and 326*c*) is different from the colour provided by at least another one of the regions 326*a* to 326*c* (e.g., region 326*b*), which can be achieved by selecting whether to spray the colour paint or to spray colour paint in a different colour in the step of generating the colour layer 326. In addition, the colour provided by the colour layer 326 is black and white in FIG. 5B, but may be various colours such as red, yellow, blue, and the like, preferably, the colour provided by the colour layer 326 is different from the colour of the bottom layer 122 (shown in FIG. 2). Besides, although the regions 326*a* to 326*c* shown in FIG. 5B are horizontally juxtaposed block regions, in other embodiments (not shown), they may be in more detailed graphics, such as specific decorative graphics or trademark graphics, and the present invention is not limited thereto. As such, the light emitting pattern P3 of the light emitting film 320 is formed by the pattern of the pattern layer 324 comprised of the motifs 324*a* and the colour provided by the colour layer 326 having at least one of the regions 326*a* to 326*c* with a different colour or without that colour.

Figures 6A, 6B, 6C:
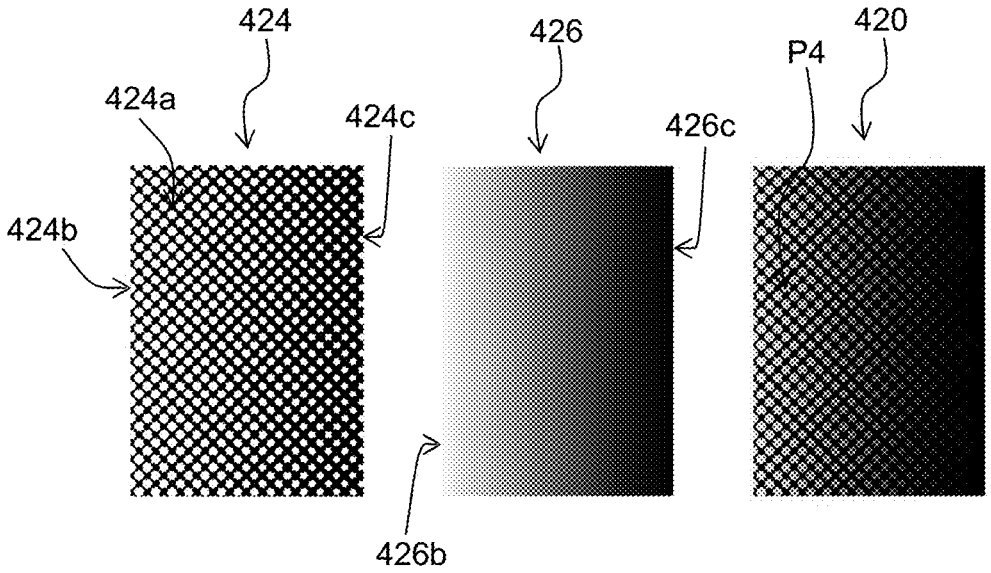
FIG. 6A to FIG. 6C are plan views of a pattern layer, a colour layer and a light emitting film according to yet another embodiment of the present invention.

FIG. 6A to FIG. 6C are plan views of the pattern layer, the colour layer and the light emitting film according to yet another embodiment of the present invention. Referring to FIG. 6A to FIG. 6C, in the present embodiment, the pattern layer 424, the way the colour layer 426 and the light emitting film 420 are substantially disposed is similar to the pattern layer 124, the colour layer 126 and the light emitting film 120 in FIG. 3A to FIG. 3C. The pattern layer 424 provides a pattern (as shown in FIG. 6A), and the colour layer 426 provides a colour (as shown in FIG. 6B) such that the light emitting film 420 forms a light emitting pattern P4 having the pattern and the colour (as shown in FIG. 6C). Thus, the main differences between the light emitting film 420 and the light emitting film 120 are the pattern provided by the pattern layer 424 and the colour provided by the colour layer 426.

In detail, in the present embodiment, the pattern layer 424 includes a plurality of motifs 424*a* in the same shape, for example, a circular motif. The motifs 424*a* are spaced a gap apart from each other and continuously arranged, and the size of the motifs 424*a* varies from the one side to the other side of the pattern layer 424, for example, the size of the motifs 424*a* shown in FIG. 6A decreases from the left side 424*b* to the 424*c* (or the size of the motifs 424*a* increases from the right side 424*c* to the left side 424*b*). However, in other embodiments (not shown), the arrangement density of the motifs 424*a* on the pattern layer 424 varies from one side to the other side of the pattern layer 424, or may have other dispositions and variations. Moreover, the colour provided by the colour layer 426 has a gradual change from one side to the other side of the colour layer 426. For example, as shown in FIG. 6B, the colour deepens from the left side 426*b* to the right side 426*c*. However, the gradual change may also start from the middle to the left and right sides or the upper and lower sides of the colour layer 426, or may be irregular, which may be adjusted according to requirements. In addition, the colour provided by the colour layer 426 is in grey scale in FIG. 6B, but may be various colours such as red, yellow, blue, and the like, preferably, the colour provided by the colour layer 426 is different from the colour of the bottom layer 122 (shown in FIG. 2). The gradual effect in the colour layer 426 can be achieved by controlling the spray manner in which the colour paint is sprayed (e.g., spray time, spray direction, or spray amount) from one side to the other side, but the present invention is not limited thereto. As such, the light emitting pattern P4 of the light emitting film 420 is formed by the pattern of the pattern layer 424 comprised of the motifs 424*a* and the colour provided by the colour layer 1426 having the gradual change.

It can be seen that, in various embodiments illustrated in FIG. 3A to FIG. 6C, the main purpose of the pattern layers 124 to 424 is to provide a different pattern comprised of various types of the motifs 124*a* to 424*a* to change the plain appearance of the light emitting films 120 to 420, the main purpose of the colour layers 126 to 426 is to provide a colour change for the light emitting films 120 to 420, presenting a different colour from the bottom layer 122, and further to adopt a gradual change (as shown in FIG. 3B and FIG. 6B) or a splicing change (as shown in FIG. 4B and FIG. 5B) to provide an appearance effect more than just a uniform colour. Therefore, the light emitting film of the present invention may be any arrangement combination of one of the various pattern layers 124 to 424 mentioned above and one of the colour layers 126 to 426 mentioned above, and is not limited to the pattern layers 124 to 424 and the colour layers 126 to 426 used as described above, which can be adjusted according to requirements, for example, the pattern of the pattern layer is adjusted to be irregularly arranged or have a special shape, or the region of the colour layer is adjusted to be located at a specific decorative graphic or trademark graphic, and the present invention is not limited thereto.

Based on the above, the light emitting module of the present invention includes a working piece and a light emitting film. The light emitting film includes a bottom layer for emitting light according to a voltage difference, a pattern layer for providing a pattern, and a colour layer for providing a colour, so that the light emitting film forms a light emitting pattern with the pattern and the colour on the light emitting area of the working piece. In particular, the pattern of the pattern layer is composed of a plurality of motifs with different arrangements, and the colour of the colour layer has a gradual change or a splicing change, and therefore the pattern layer having the pattern comprised of the motifs with different arrangements and the colour layer having the colour with different variation can be chosen and combined into a light emitting pattern according to requirements. Therefore, compared with the conventional light emitting module, the light emitting module of the present invention needs neither light emitting elements, such as a light emitting diodes nor optical elements, such as a light guiding column. The light emitting film can be applied to various materials or working pieces having complicated shapes, and can further cope with different patterns and colours to achieve different appearances. Thereby, the light emitting module of the present invention is more diverse and practical, and is beneficial to the thinning development of products.

Although the present invention has been disclosed with the aforementioned embodiments, it is not intended to limit the present invention. Any person having ordinary skill in the art can make some changes and modifications without departing from the spirit and scope of the present invention. Therefore, the protection scope of the present invention shall be defined by the appended claims.

What is claimed is:

1. A light emitting module, comprising:

a working piece; and a light emitting film, disposed on a surface of the working piece and used for emitting light according to a voltage difference, the light emitting film comprising:

a bottom layer, disposed on the surface of the working piece;

a pattern layer, disposed on the bottom layer for providing a pattern; and a colour layer, disposed on the bottom layer for providing a colour, wherein the pattern layer and the colour layer are overlapped with each other over the bottom layer, so that the light emitting film forms a light emitting pattern with the pattern and the colour on the working piece.

2. The light emitting module according to claim 1, wherein the pattern layer comprises a plurality of motifs in the same shape, the motifs are spaced apart from each other with a gap and continuously arranged.

3. The light emitting module according to claim 2, wherein the motifs are identical in size to each other.

4. The light emitting module according to claim 2, wherein the size or arrangement density of the motifs varies from the middle to the two sides of the pattern layer.

5. The light emitting module according to claim 2, wherein the size or arrangement density of the motifs varies from one side to the other side of the pattern layer.

6. The light emitting module according to claim 2, wherein the pattern layer is located between the bottom layer and the colour layer, and the colour of the colour layer covers the motifs and the spacing gaps of the motifs.

7. The light emitting module according to claim 2, wherein the colour layer is located between the bottom layer and the pattern layer, and the colour of the colour layer is displayed through the spacing gaps of the motifs.

8. The light emitting module according to claim 1, wherein the colour provided by the colour layer is different from the colour of the bottom layer.

9. The light emitting module according to claim 1, wherein the colour provided by the colour layer produces a gradual change from one side to the other side of the colour layer.

10. The light emitting module according to claim 1, wherein the colour layer comprises a plurality of adjacent regions, at least one of the regions provides the colour, and at least another one of the regions does not possess the colour.

11. The light emitting module according to claim 1, wherein the colour layer comprises a plurality of adjacent regions, and the colour provided by at least one of the regions is different from the colour provided by at least another one of the regions.

12. The light emitting module according to claim 1, wherein the bottom layer comprises a backing layer, a dielectric layer, a light emitting layer and a conductive layer sequentially disposed on the working piece, the backing layer defines a light emitting region on the working piece, the dielectric layer, the light emitting layer and the conductive layer are sequentially disposed on the backing layer, and the voltage difference across the backing layer and the conductive layer excites the light emitting layer to emit light.

13. The light emitting module according to claim 1, wherein the light emitting film further comprises a transparent layer disposed on the pattern layer and the colour layer, and located on the outermost side of the light emitting film.

* * * * *